US007920103B2

(12) United States Patent
Woon et al.

(10) Patent No.: US 7,920,103 B2
(45) Date of Patent: Apr. 5, 2011

(54) PLASMA DISPLAY APPARATUS AND DRIVING METHOD THEREOF

(75) Inventors: Won Sik Woon, Gumi-si (KR); Won Jae Kim, Masan-si (KR); Kyoung Jin Jung, Gumi-si (KR); Hyun Lark Do, Daegu-si (KR)

(73) Assignee: LG Electronics Inc., Seoul (KR)

( * ) Notice: Subject to any disclaimer, the term of this patent is extended or adjusted under 35 U.S.C. 154(b) by 868 days.

(21) Appl. No.: 11/422,216

(22) Filed: Jun. 5, 2006

(65) Prior Publication Data

US 2007/0063930 A1 Mar. 22, 2007

(30) Foreign Application Priority Data

Sep. 16, 2005 (KR) ..... 10-2005-0087055

(51) Int. Cl.
*G09G 3/28* (2006.01)

(52) U.S. Cl. ..... 345/60

(58) Field of Classification Search ..... 345/60–72; 315/169.4

See application file for complete search history.

(56) References Cited

U.S. PATENT DOCUMENTS

| | | | | |
|---|---|---|---|---|
| 6,020,687 | A | 2/2000 | Hirakawa | |
| 2002/0005822 | A1 | 1/2002 | Lee et al. | 345/60 |
| 2004/0227701 | A1 | 11/2004 | Chung et al. | 345/60 |
| 2005/0093779 | A1 | 5/2005 | Kim et al. | 345/60 |
| 2005/0116889 | A1 | 6/2005 | Whang | |

FOREIGN PATENT DOCUMENTS

| | | |
|---|---|---|
| CN | 1612191 | 5/2005 |
| CN | 1619618 A | 5/2005 |
| EP | 1 280 124 | 1/2003 |
| EP | 1 376 524 | 1/2004 |
| EP | 1 748 407 | 1/2007 |

OTHER PUBLICATIONS

Chinese Office Action dated Jul. 25, 2008 for Application No. 200610086463.X, 7 pages.
European Search Report dated Oct. 7, 2008 for Application No. 06011523.5, 9 pagaes.
Office action dated Mar. 20, 2009 for Application No. 200610086463.X, 10 pages.

*Primary Examiner* — Amr Awad
*Assistant Examiner* — Kenneth Bukowski
(74) *Attorney, Agent, or Firm* — Fish & Richardson P.C.

(57) ABSTRACT

The present invention relates to a plasma display apparatus, and more particularly, to a driving method thereof. The plasma display apparatus includes a panel comprised of a first substrate and a second substrate bonded to each other, a first electrode and a second electrode formed on the upper substrate, and a sustain driver for applying sustain pulses to the first and second electrodes, wherein the sustain driver applies a sustain voltage between the first and second electrodes, and floats at least one of the first and second electrodes after the completion of a sustain discharge caused by the sustain voltage.

In the plasma display apparatus and the driving method thereof, according to the present invention, at least one of a scan electrode and a sustain electrode is floated for a predetermined time after the completion of the sustain discharge. This floating state prevents wall charges that are generated during the sustain discharge from being accumulated and increases a discharge path of a plasma display apparatus using a space voltage, thereby improving afterimage characteristic and enhancing brightness and discharge efficiency.

15 Claims, 18 Drawing Sheets

PLASMA DISPLAY APPARATUS AND DRIVING METHOD THEREOF

BACKGROUND OF THE INVENTION

1. Field of the Invention

The present invention relates to a plasma display apparatus, and more particularly, to a plasma display apparatus in which brightness and discharge efficiency are enhanced by using a space voltage in a discharge cell and a driving method thereof.

2. Description of the Background Art

A plasma display apparatus is included of a front substrate, a rear substrate, and discharge cells formed between the front substrate and the rear substrate. Further, the plasma display apparatus displays an image by exciting phosphors by vacuum ultraviolet rays, generated when an inert gas in discharge cells is discharged clue to a high voltage.

FIG. 1 is an exploded perspective view illustrating a structure of a discharge cell of a surface discharge type AC plasma display panel.

The surface discharge type AC plasma display panel is manufactured by forming a plurality of films on two flat glass substrates serving as an upper substrate 10 and a lower substrate 20 and bonding the two flat glass substrates to each other. The upper substrate 10 and the lower substrate 20 are arranged to face each other. Scan electrodes Y and sustain electrodes Z are formed on the upper substrate 10 and address electrodes X are formed on the lower substrate 20.

Each of scan electrodes Y is included of a transparent electrode 12Y and a metal bus electrode 13Y having a narrower width than the transparent electrode 12Y, and each of sustain electrodes Z is included of a transparent electrode 12Z and a metal bus electrode 13Z having a narrower width than the transparent electrode 12Z. An upper dielectric layer 14 and a protective layer 16 are stacked on the upper substrate 10 so as to cover the scan electrodes Y and the sustain electrodes Z. Wall charges generated during plasma discharging are accumulated on the upper dielectric layer 14. The protective layer 16 acts to prevent the sputtering occurring during the plasma discharging causing damage to the upper dielectric layer 14, and to enhance emission efficiency of secondary electrons.

The lower substrate 20 is covered with a lower dielectric layer 22, and barrier ribs 24 are formed on the lower dielectric layer in order to prevent UV rays and visible light rays generated in a discharge cell by the discharging leaking into adjacent discharge cells. The lower dielectric layer 22 and the barrier ribs 24 are covered with a phosphor 26. The phosphor 26 is excited by UV rays generated during the plasma discharging, thereby emitting a color of visible light rays among red, green and blue.

FIG. 2 illustrates voltage waveforms of driving pulses for driving a plasma display panel in a time divisional manner, in which one frame is divided into a plurality of sub-fields. The plasma display panel is generally driven in a time divisional manner by dividing a single frame into a plurality of subfields, during which different numbers of discharge operations are caused, in order to express a gray level. Each subfield is divided into a reset period for initializing all discharge cells, an address period for selecting a scan line and discharge cells to be discharged among discharge cells connected to the selected scan line, and a sustain period for expressing the gray level according to the number of discharge operations.

For example, in case that the image is displayed in 256 gray levels, one frame period (16.67 ms) corresponding to 1/60 second is divided into eight sub-fields SF1 to SF8 as shown in FIG. 2. Each of the sub-fields SF1 to SF7 is divided into a reset period, an address period and a sustain period.

The reset period and the address period are the same for each sub-field. However, the sustain period and the number of sustain pulses applied to electrodes in the sustain period are different and increase in a ratio of $2^n$ (n=0, 1, 2, 3, 4, 5, 6, 7) for each sub-field. In this way, since the sustain periods of the sub-fields for implementing the gray level according to the number of discharge operations are different for each subfield, it is possible to express a gray level by the sub-fields, and is possible to display a single image frame by the combination of the sub-fields.

FIG. 3 is a voltage waveform of sustain pulses applied to electrodes in a sustain period. One period of sustain pulses includes an energy recovery up time (ER_up time), a sustain up time (Sus_up time), and an energy recovery down time (ER_down time).

As described above, according to the conventional driving method of a plasma display apparatus, the waveform of sustain pulses applied to electrodes in the sustain period is fixed. That is, the energy recovery up time, the energy recovery down time, and the sustain up time during a single period of sustain pulses do not vary.

SUMMARY OF THE INVENTION

Accordingly, a feature of the present invention is to solve at least the problems and disadvantages of the related art, thereby there are provided a plasma display apparatus in which a discharge path is increased in order to enhance brightness and discharge efficiency, and provided a driving method of the plasma display apparatus.

To achieve these and other advantages, there is provided a plasma display apparatus including: a plasma display panel comprised of an upper substrate and a lower substrate, the upper and lower substrates being bonded together; a first electrode and a second electrode formed on the upper substrate; and a sustain driver for applying sustain pulses to the first and second electrodes, wherein the sustain driver floats at least one of the first electrode and the second electrode for 100 to 1000 nanoseconds after applying a sustain voltage between the first electrode and the second electrode.

The sustain driver may preferably float at least one of the first electrode and the second electrode for 300 to 1000 nanoseconds.

The sustain driver may preferably float the second electrode after applying a sustain voltage to the first electrode.

The sustain driver may preferably float at least one of the first electrode and the second electrode and then apply a signal falling to a first predetermined voltage to at least one of the first electrode and the second electrode.

The sustain driver may preferably flat at least one of the first electrode and the second electrode and then apply a signal rising to a second predetermined voltage to at least one of the first electrode and the second electrode.

A floating period during which at least one of the first electrode and the second electrode is floated may be ½ times a low level sustaining period of the sustain pulses or shorter, or 2/1 times a high level sustaining period of the sustain pulses or shorter.

At least one of the first electrode and the second electrode may be floated at a halfway point of a low level sustaining period or a high level sustaining period of the sustain pulse or thereafter.

The sustain driver may float the first electrode and the second electrode alternately. The sustain driver may apply a voltage whose magnitude is ½ times the sustain voltage to at least one of the first electrode and the second electrode, and then float the electrode applied with the voltage.

The sustain driver may apply a negative voltage whose magnitude is ½ times the sustain voltage to one of the first electrode and the second electrode, and then float the electrode applied with the negative voltage.

The sustain driver may apply a ground voltage to one of the first and second electrodes, and then float the electrode applied with the ground voltage.

The sustain driver may apply the sustain voltage to one of the first and second electrodes, and then float the electrode applied with the sustain voltage.

The sustain driver may apply the sustain voltage having a negative magnitude to one of the first and second electrodes, and then float the electrode applied with the negative sustain voltage.

In order to achieve the above-mentioned advantages, there is provided a sustain driving method of a plasma display apparatus, including (a) applying a sustain voltage between a first electrode and a second electrode, and (b) floating at least one of the first electrode and the second electrode for 100 to 1000 nanoseconds.

During the floating, at least one of the first electrode and the second electrode may be floated for 300 to 1000 nanoseconds. Further, during the floating, at least one of the first electrode and the second electrode may be floated for a time corresponding to ½ times a high level sustaining period or a low level sustaining period of the sustain pulses.

During the floating, at least one of the first electrode and the second electrode may be floated at a halfway point of the low level sustaining period or the high level sustaining period of the sustain pulses.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

A plasma display apparatus and a sustain driving method of the same, according to the present invention are not limited to embodiments described below, but there can be many embodiments of the plasma display apparatus and the driving method thereof other than the following embodiments.

Hereinafter, a plasma display apparatus and a sustain driving method of the same according to embodiments of the present invention will be described in more detail with reference to FIGS. 4 through 11.

In order to display an image on a plasma display panel, the plasma display panel is driven by dividing a single frame into a plurality of sub-fields. Each sub-field is divided into a reset period for initializing all discharge cells, an address period for selecting discharge cells to be discharged according to image data, and a sustain period for displaying an image by sustain discharges.

During the sustain period, a scan electrode Y and a sustain electrode Z are alternately applied with sustain pulses, so that a gray level can be expressed as sustain discharges occur when the sustain pulses are applied.

Generally, a single sustain pulse is comprised of an energy recovery up time (ER_up) during which the sustain pulse rises to a high level of the sustain voltage (the highest magnitude), a sustain period (Sus-up) for maintaining the high level of the sustain voltage, and an energy recovery down period (ER_down) during which the sustain pulse falls from the high level to a low level.

Figure 1:
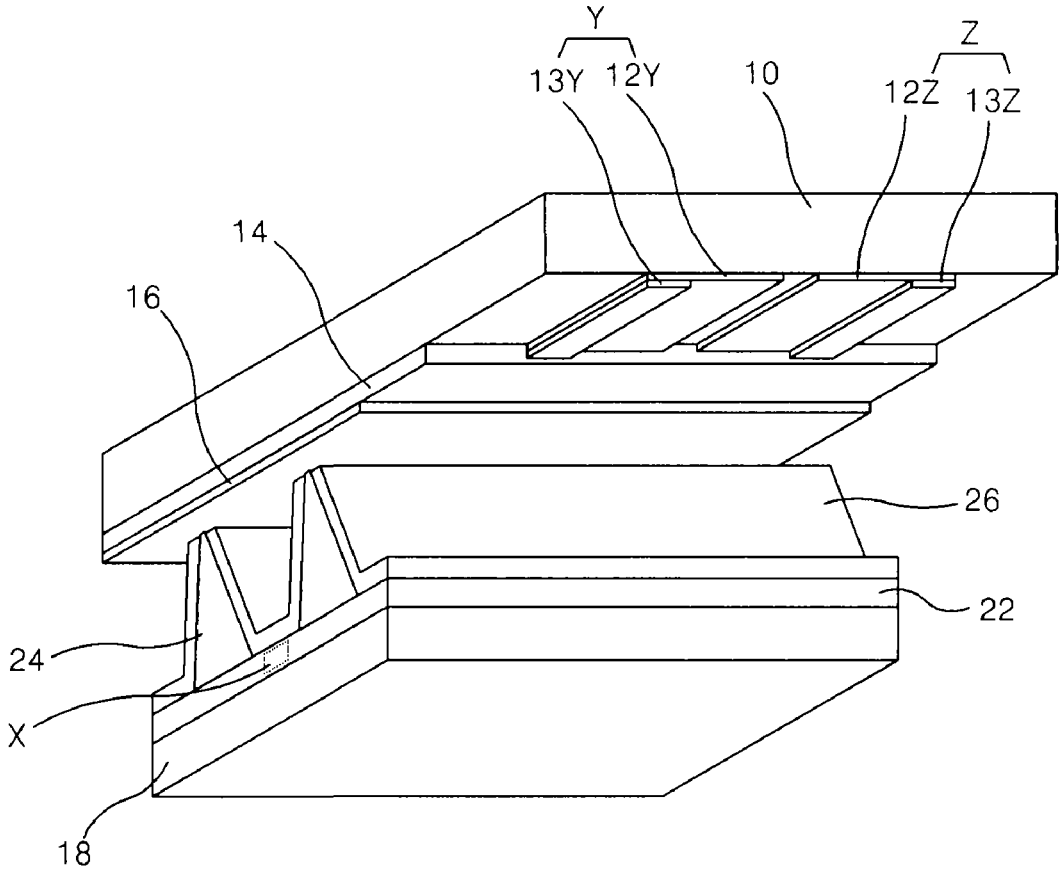
Fig.1 (related art)
FIG. 1 is a perspective view illustrating a structure of a discharge cell of a general plasma display panel.
Figure 2:
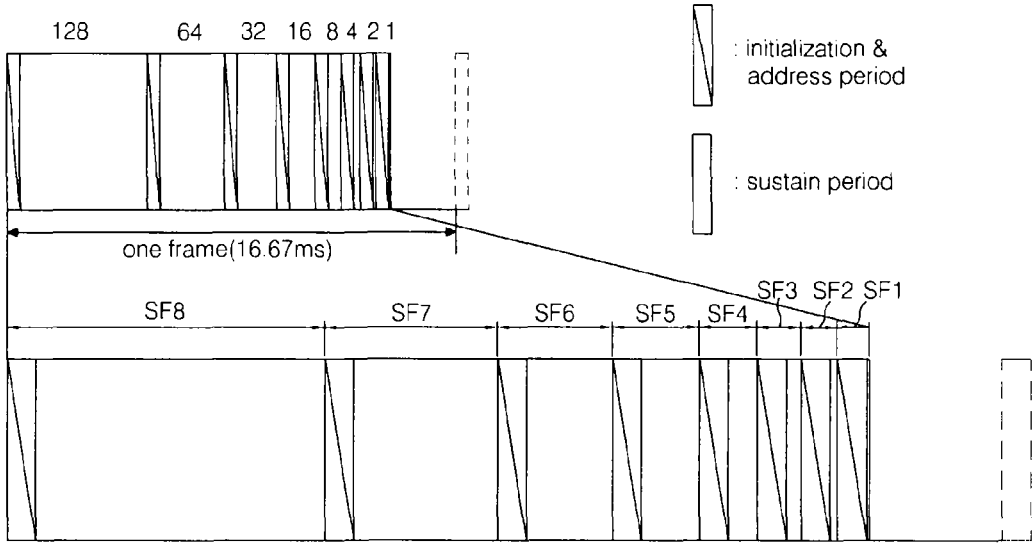
Fig.2 (related art)
FIG. 2 is a view illustrating a method of driving a plasma display panel in a time divisional manner by dividing a single frame into a plurality of sub-fields.
Figure 3:
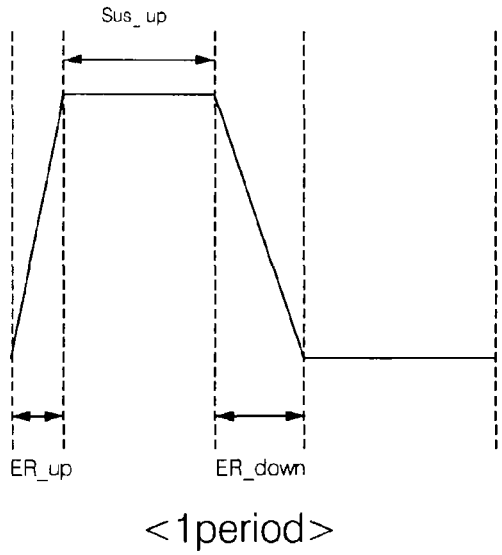
Fig.3 (related art)
FIG. 3 is a timing diagram illustrating waveforms of sustain pulses applied to electrodes for a sub-field period.
Figure 4:
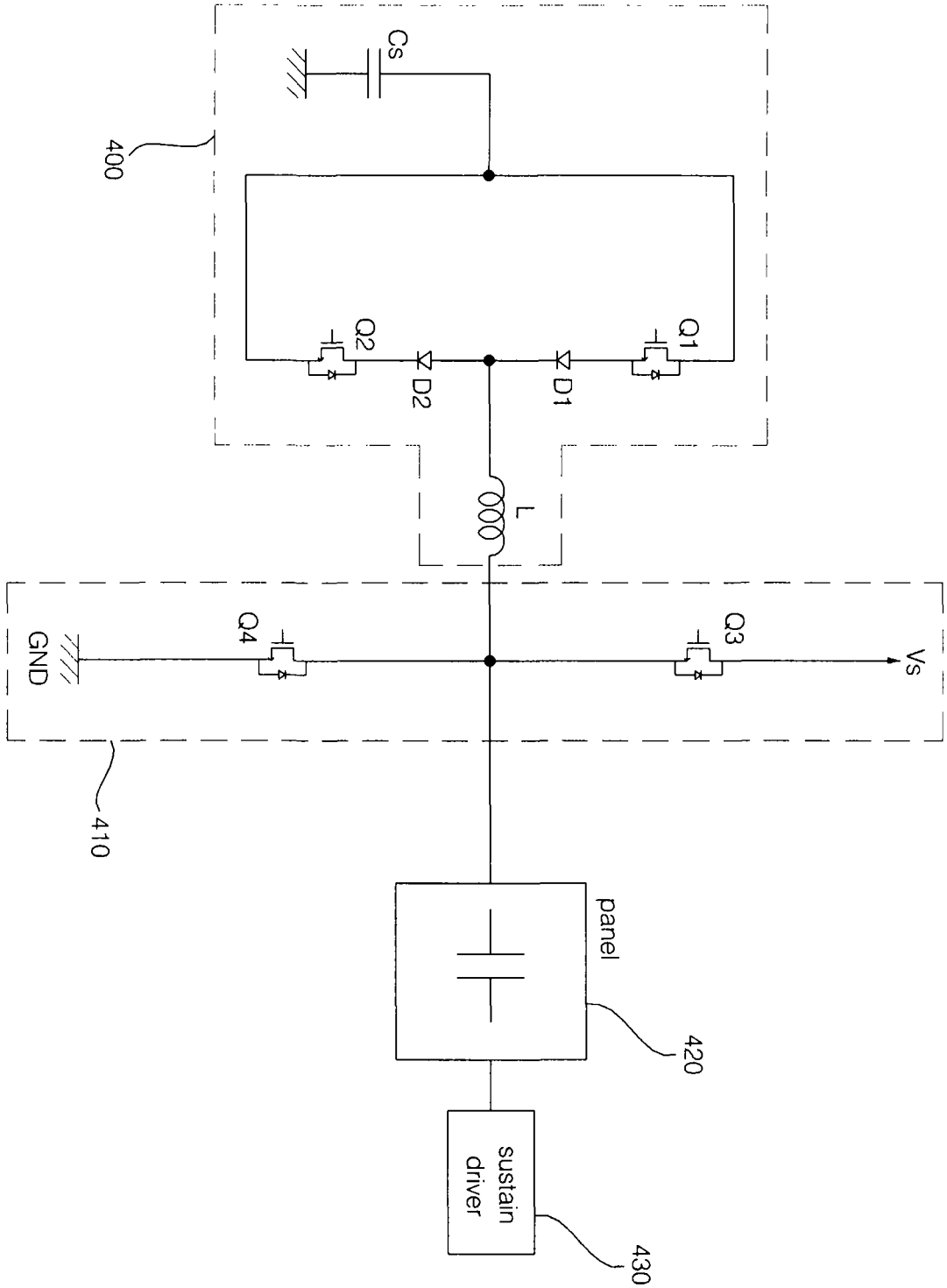
FIG. 4 is a circuit diagram illustrating a sustain driver of a plasma display apparatus according to one embodiment of the present invention.

FIG. 4 is a circuit diagram illustrating a sustain driver which applies sustain pulses to the plasma display panel. The sustain driver includes an energy recovery unit 400 connected between a panel and a source capacitor Cs, an inductor L constituting a resonance circuit together with the panel, and a first switch Q1 and a second switch Q2, being parallely connected between the source capacitor Cs and the inductor L. The source capacitor Cs recovers energy charged in a panel capacitor during the sustain discharge and returns the recovered energy to the panel capacitor.

A sustain pulse supply unit 410 is connected in parallel between the inductor L and the panel, and includes a third switch Q3 connected to a power supply voltage Vs and turned on in order to supply a high level of the sustain voltage and a fourth switch Q4 connected to a ground voltage GND in order to decrease the voltage of the panel to the ground voltage GND.

When the first switch Q1 is turned on, the energy charged in the source capacitor Cs is supplied to the panel capacitor, so that the magnitude of the sustain pulse applied to the panel increases during an energy recovery up time (ER_up time). After that, when the third switch Q3 is turned on, the magnitude of the sustain pulse reaches a high level of the sustain voltage and the sustain voltage is maintained for a sustain up time (Sus_up time).

If the second switch Q2 is turned on, the energy charged in the panel capacitor is recovered to the source capacitor Cs, so that the magnitude of the sustain pulse decreases during an energy recovery down time (ER_down time). After that, if the fourth switch Q4 is turned on, the magnitude of the sustain pulse falls to the ground voltage.

Generally, the sustain pulse is alternately applied to the scan electrode Y and the sustain electrode Z during a sustain period. That is, the sustain voltage Vsus is supplied between the scan electrode Y and the sustain electrode Z, thereby causing the sustain discharges during the sustain period. A wall voltage generated between the scan electrode Y and the sustain electrode Z during the sustain discharge occurring during the sustain period continuously causes sustain discharges.

According to the present invention, in order to enhance the discharge efficiency using a space voltage generated in the discharge cell, the switches Q1, Q2, Q3, and Q4 are brought into open right after the completion of the sustain discharge in a high level sustaining period, a low level sustaining period, or a ground voltage sustaining period of the sustain pulse, thereby floating the scan electrode Y and the sustain electrode Z. In the case that the floating of the scan and sustain electrodes is started before the completion of the sustain discharge, the discharge can not be caused sufficiently, so that the sufficient space voltage is not generated, resulting in deterioration of the discharge efficiency.

Accordingly, in the case that the switches Q1, Q2, Q3, and Q4 are open, current of the sustain pulse cannot be flown to the scan electrode Y and the sustain electrode Z, so that wall charges are not accumulated any more on the electrodes, but the space voltage is generated. The space voltage causes continuous sustain discharges.

The starting point of the floating period in the sustain pulse is preferably a time point when the sustain pulse is applied to the scan electrode Y and the sustain electrode Z, and then the discharge is completed. Alternatively, the starting point of the floating period is a halfway point of a high level sustaining period or a low level sustaining period of the sustain pulse, or is in a later half of a high level sustaining period or a low level sustaining period of the sustain pulse.

The floating period is preferably about 100 to 1000 nanoseconds. If the floating period is shorter than 100 nanoseconds, a large amount of wall charges is accumulated, but space charges are not sufficiently generated to form a critical space voltage. That is, when the floating period is 100 nanoseconds or more, space charges are sufficiently formed to be a space voltage being useful to improve afterimage characteristic and reduce power consumption.

On the other hand, if the floating period is beyond 1000 nanoseconds, space charges formed due to the floating are extinguished thanks to recombination, the amount of space charges is reduced, so that a space voltage cannot reach a critical level. Accordingly, the floating period is set to be less than 1000 nanoseconds, so that space charges are sufficiently formed to be a space voltage useful to reduce afterimages and power consumption.

The floating period is preferably about 300 to 1000 nanoseconds.

The waveforms of the sustain pulses shown in the accompanying drawings are illustrated in expanded form in order to explain in more detail the operation of the plasma display panel during the sustain voltage application period and the floating period.

Figure 5A:
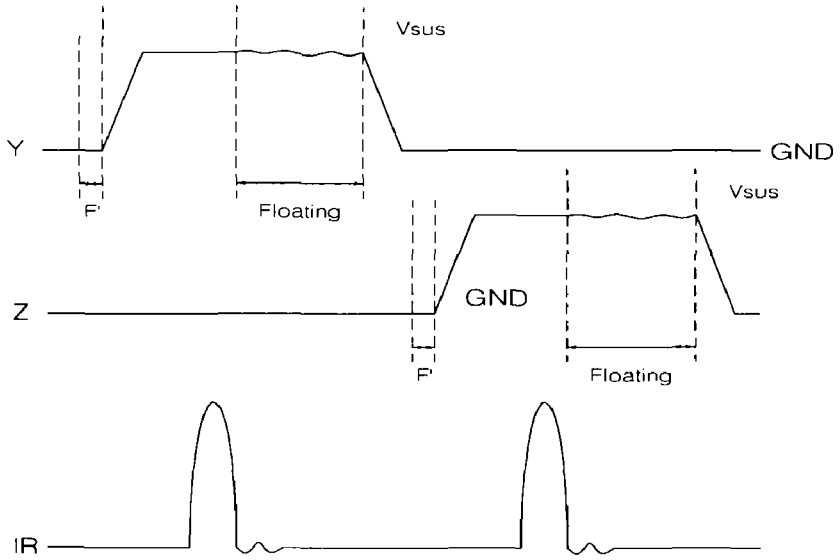
FIGS. 5A through 5C, 6A through 6B, 7A through 7H, 8A through 8D, 9A through 9B, 10A through 10D, 11A through 11D, and 12A through 12B illustrate waveforms of sustain pulses for driving a plasma display apparatus, according to a variety of embodiments of the present invention.
Figure 5B:
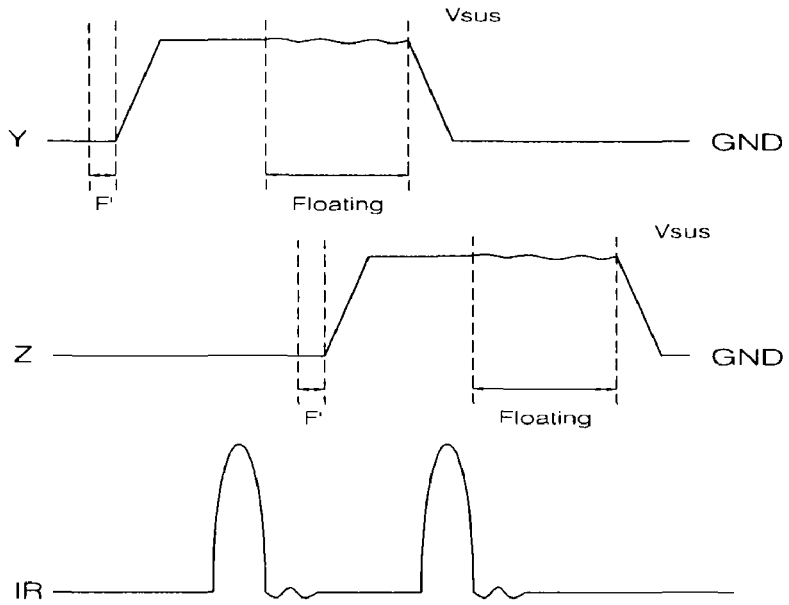
Figure 5C:
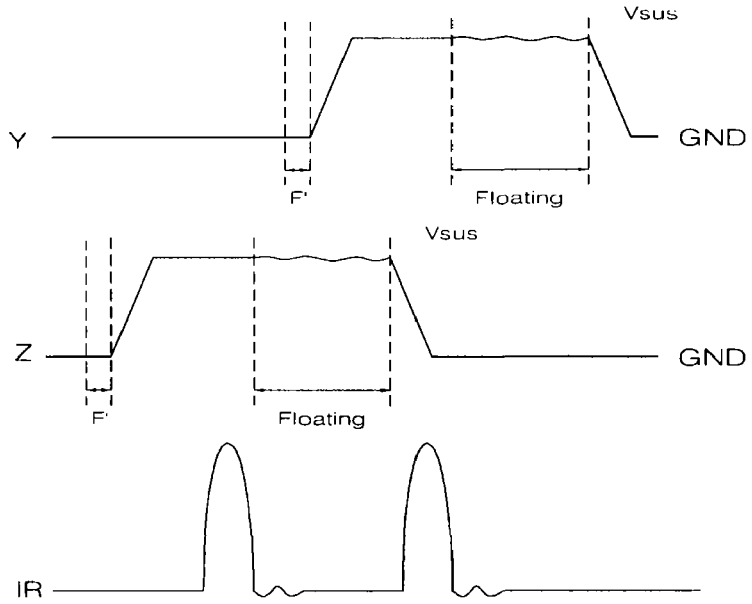

Referring to waveforms shown in FIGS. 5A through 5C, the sustain voltage period Sus_up is decreased in order to increase the floating period. In the case that the sustain pulse waveform is applied, the sustain discharge is started right after the magnitude of the sustain pulse rises during the energy recovery up time E/R_up and then finally reaches the sustain voltage Vsus.

Accordingly, the sustain voltage Vsus must be kept until the sustain discharge is completed. Next, the sustain voltage Vsus is then floated when the sustain discharge is finished, thereby inhibiting the wall voltage but generating the space voltage.

The floating period F during which at least one of the electrodes is floated is about 100 to 1000 nanoseconds. If the sustain voltage Vsus is not maintained but the electrodes are floated before the completion of the discharge, the discharge cannot be completed, so that the discharge efficiency is deteriorated.

Referring to FIGS. 5A through 5C, when the sustain pulse rises to a high level or falls to a low level, there is a floating period F' for about 100 to 200 nanoseconds needed to turn on and off switching devices.

In the case of applying data pulses to electrodes, the floating period F' is set in order to prevent current flowing to the electrodes while the switching devices become open. This results in the delay of the pulse waveform by the floating time F' when opening the switching device.

Figure 6A:
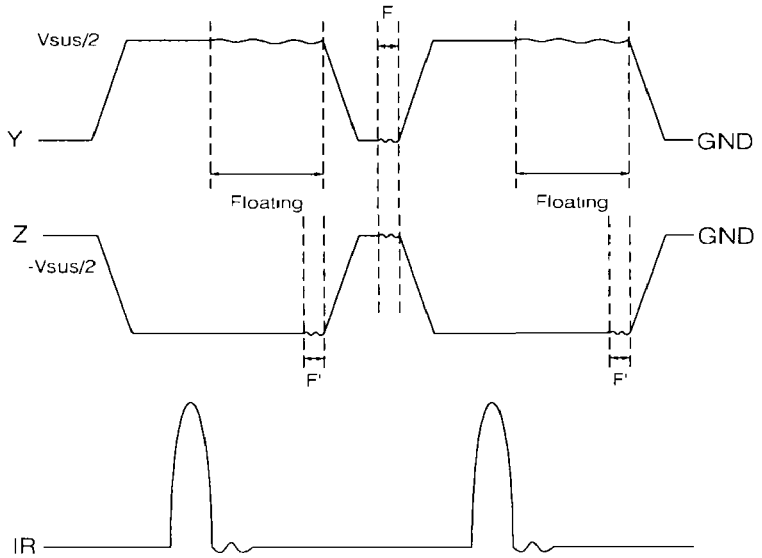
Figure 6B:
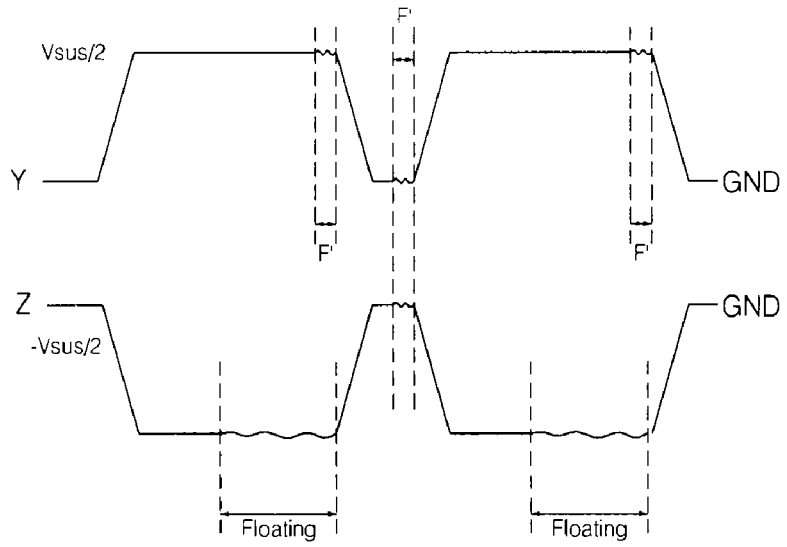

FIGS. 6A and 6B illustrate waveforms of sustain pulses in which a high level and a low level of the sustain pulse used in the sustain period are ½ Vsus and −½ Vsus, respectively.

In comparison with waveforms of sustain pulses shown in FIGS. 6A through 6B, time points of the sustain discharges are coincident with each other, but the floated electrodes are different. As shown in FIGS. 6A and 6B, although the floated electrodes are different, the same magnitude of space voltage is generated, so that the identical effect can be achieved.

In this case, the floating period F is preferably about 100 to 1000 nanoseconds.

Figure 7A:
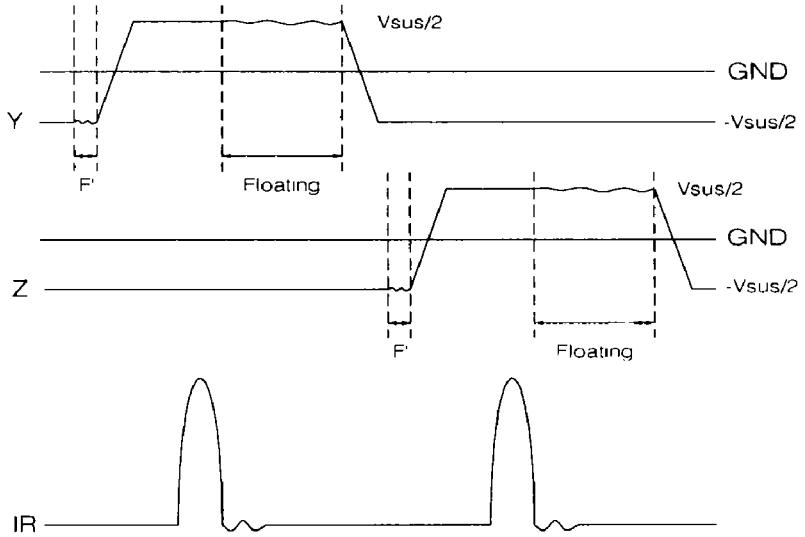

FIGS. 7A though 7H illustrate waveforms of sustain pulses in which waveforms and discharging time points are coincident with each other for all the waveforms but floated electrodes are different. In all of the cases shown in FIGS. 7A through 7H, since the space voltage is generated, the waveforms of the sustain pulses have the identical sustain effect.

Figure 7B:
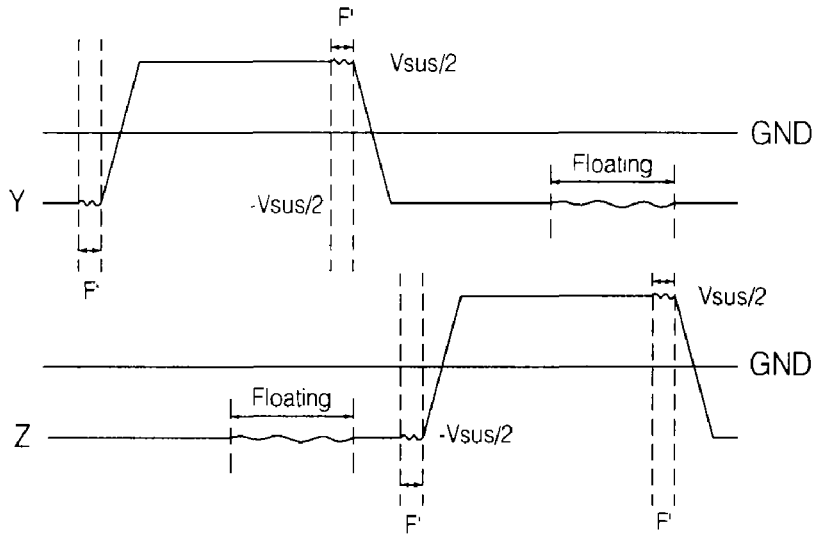
Figure 7C:
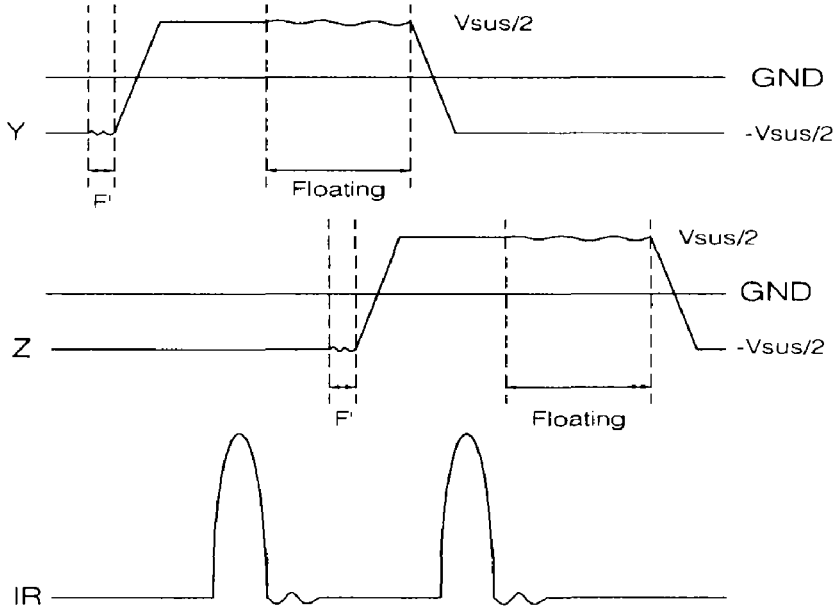
Figure 7D:
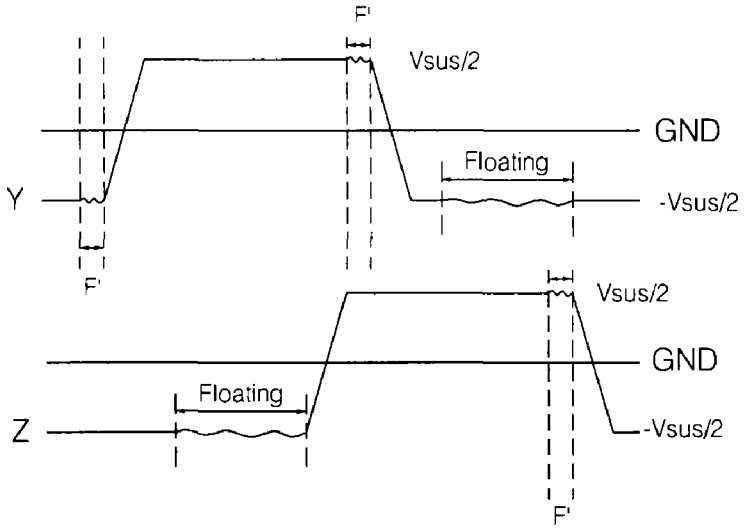
Figure 7E:
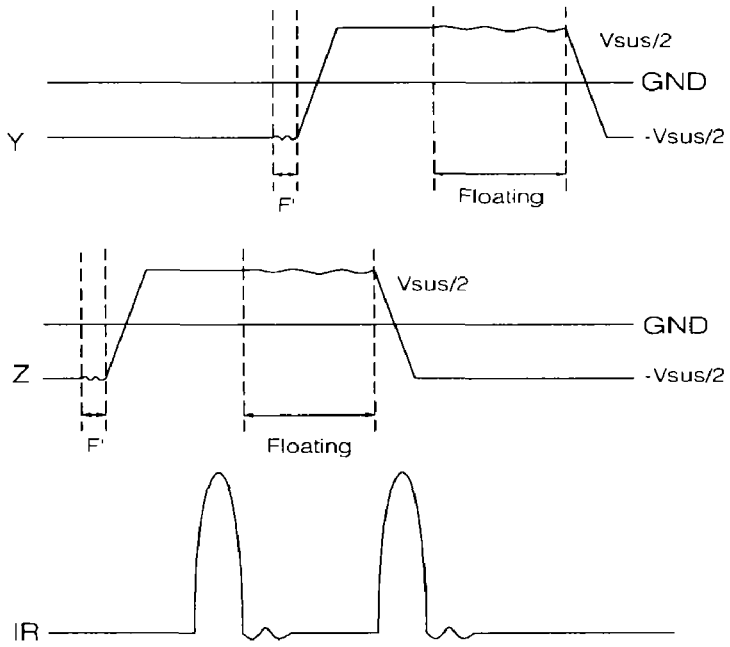
Figure 7F:
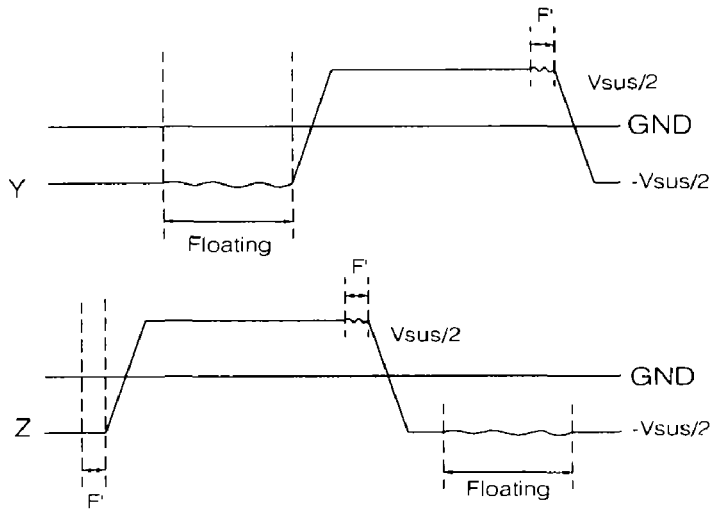
Figure 7G:
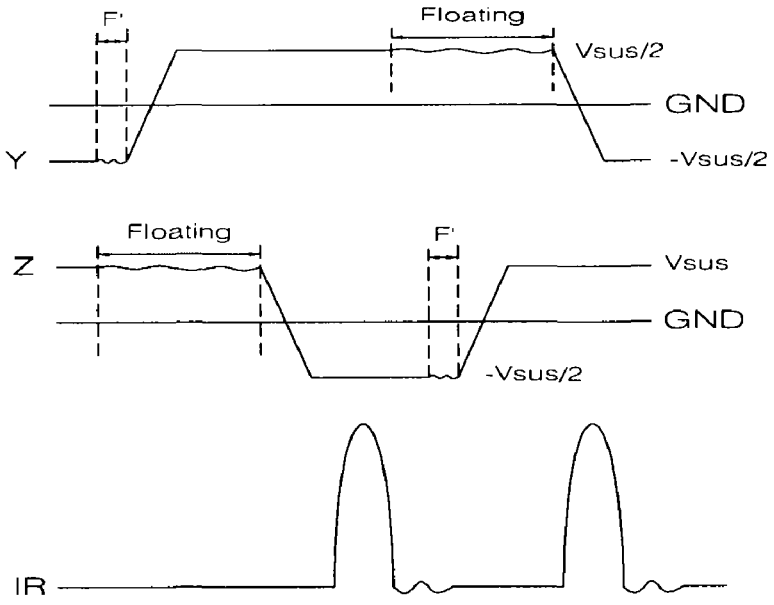
Figure 7H:
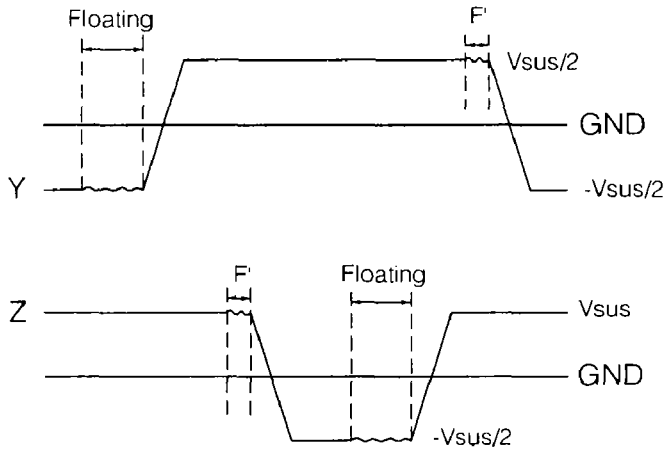

Referring to FIG. 7B, when the sustain pulse is applied to the scan electrode Y, the sustain electrode Z being applied with −½ Vsus is floated, thereby generating the space voltage, and when the sustain pulse is applied to the sustain electrode Z, the scan electrode Y being applied with −½ Vsus is floated. That is, in the case in which the sustain electrode Z is floated instead of the scan electrode Y at the identical timing as in FIG. 7B, the same effect as in FIG. 7B can be obtained.

In this case, the floating period F is preferably about 100 to 1000 nanoseconds.

Referring to FIGS. 8A through 8D, waveforms of the sustain pulses having a negative voltage −Vsus are used. After the sustain discharge occurs, the electrode being applied with a negative sustain voltage −Vsus is floated, thereby generating the space voltage and causing discharges by the space voltage.

In the waveforms of the sustain pulses shown in FIGS. 8A through 8D, the floating for 100 to 1000 nanoseconds is preferably provided before the magnitude of the sustain pulse becomes to a ground level thanks to the energy recovery up voltage E/R_up.

Figure 9A:
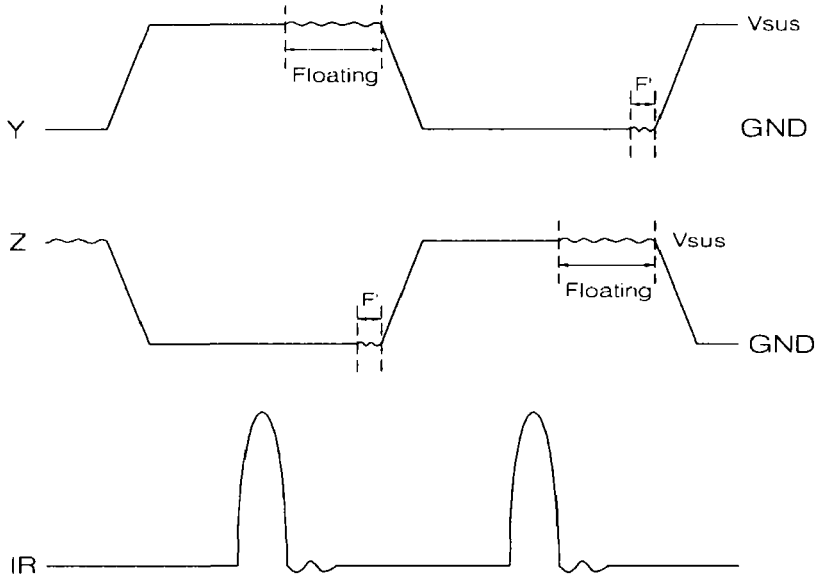
Figure 9B:
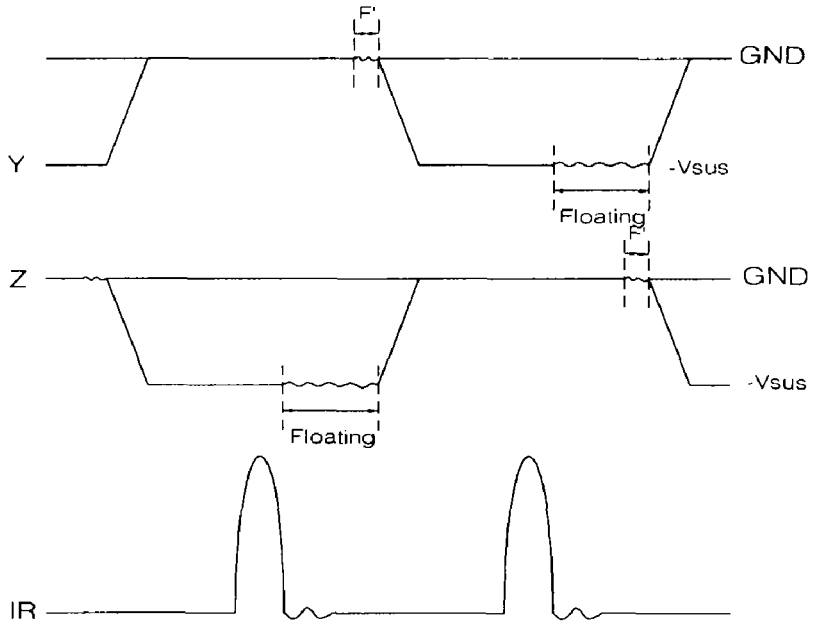

In comparison with waveforms shown in FIGS. 9A and 9B, the discharge timings are identical. However, the electrode is floated when the electrode is applied with a positive sustain voltage Vsus in the case of FIG. 9A but is floated when the electrode is applied with a negative sustain voltage −Vsus in the case of FIG. 9B. In the two waveforms shown in FIGS. 9A and 9B, the respective floating periods F are preferably about 100 to 1000 nanoseconds.

The waveforms shown in FIGS. 10A through 10D are the same as as the waveforms shown in FIGS. 5A through 5C in that they have the identical discharge timing, but are different in that the waveforms shown in FIGS. 5A through 5C float the electrode applied with the positive sustain voltage Vsus and the waveforms shown in FIGS. 10A through 10D floats the electrode applied with the ground level, wherein the floating timings for all of the cases are identical.

Figure 10A:
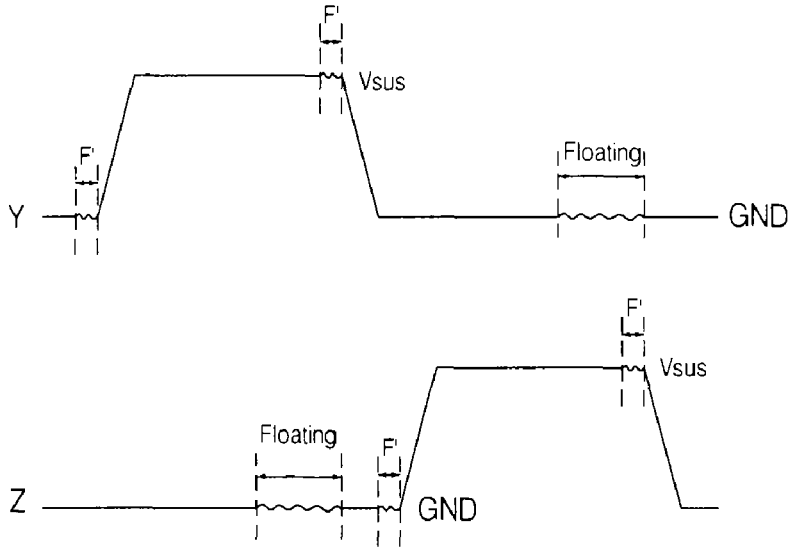
Figure 10B:
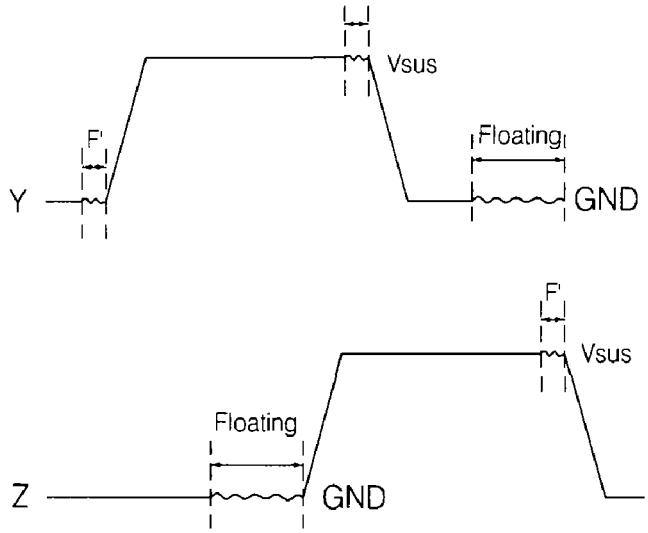
Figure 10C:
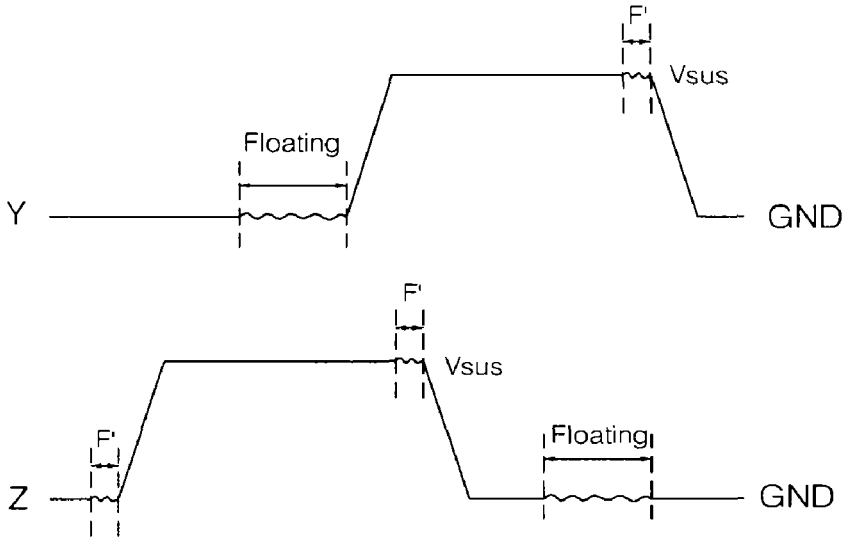
Figure 10D:
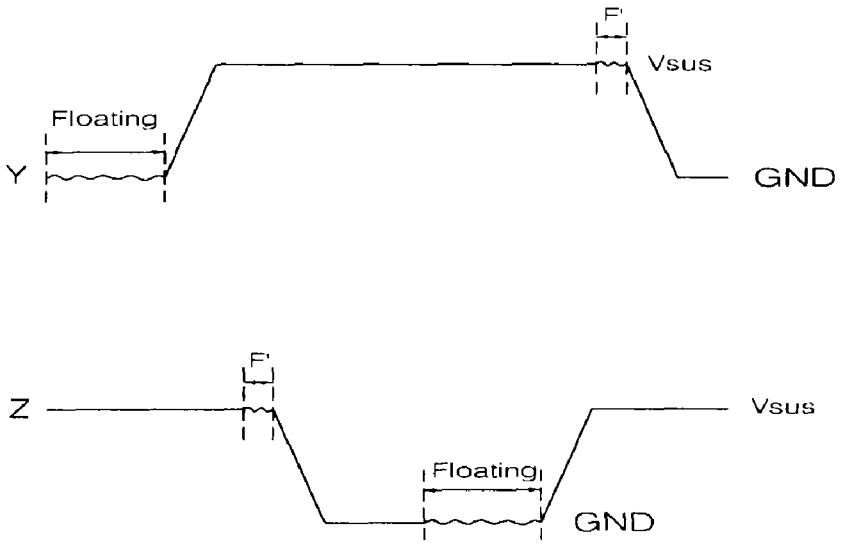
Figure 11A:
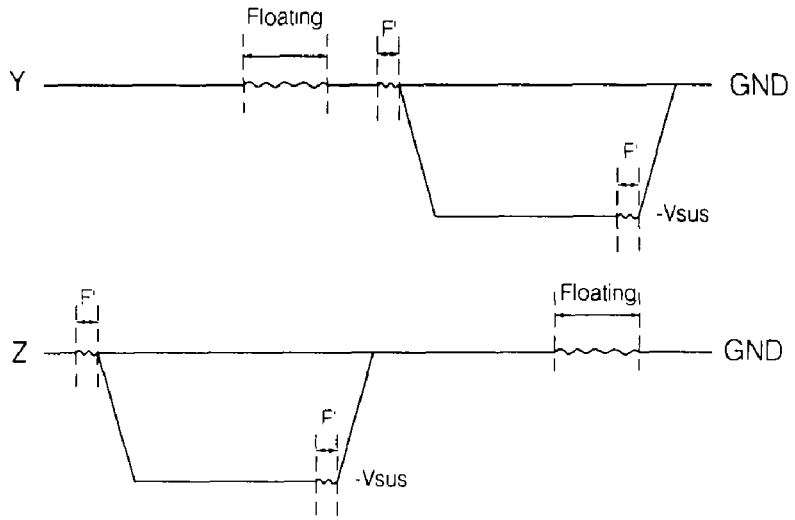
Figure 11B:
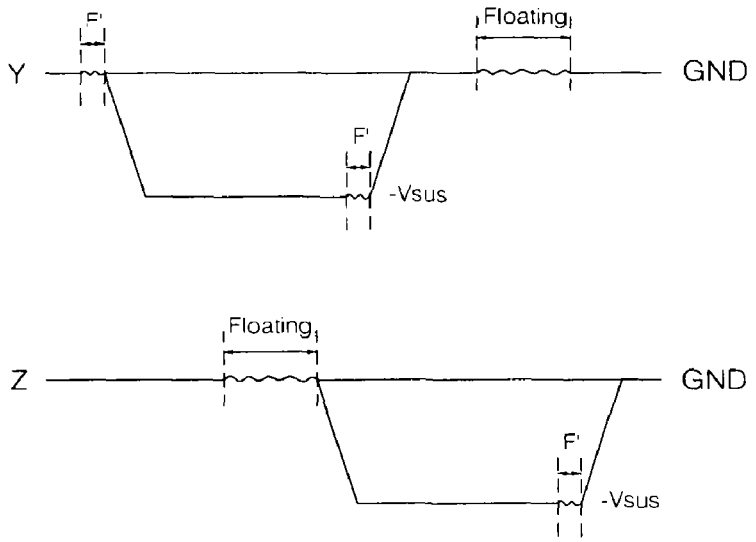
Figure 11C:
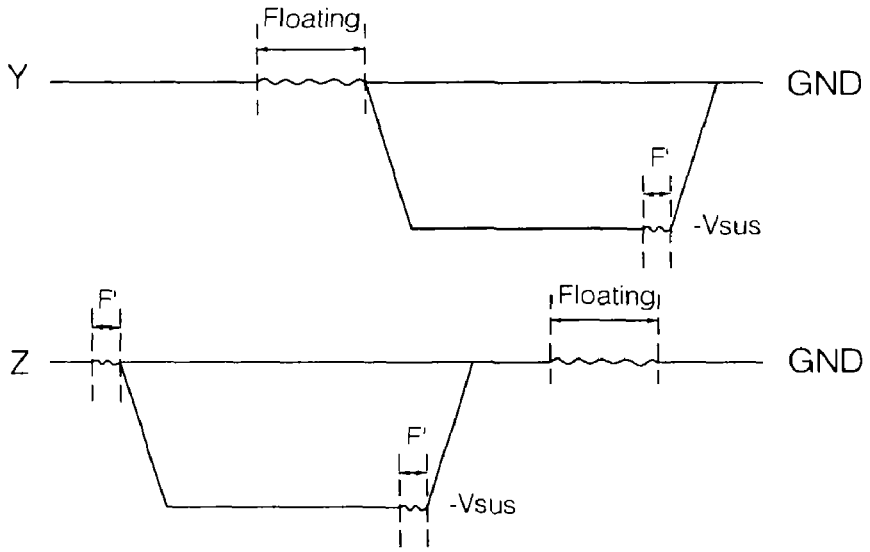
Figure 11D:
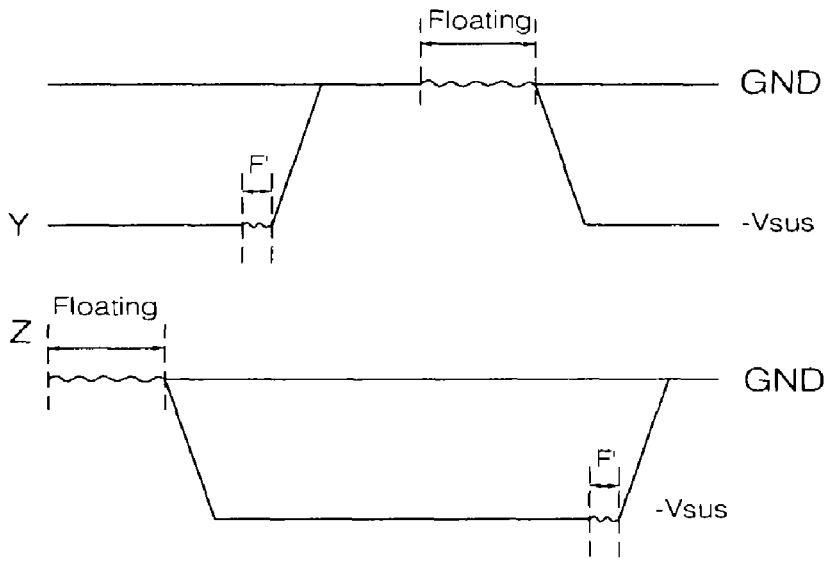

For example, as shown in FIG. 10D, in the case that the rising timing and the falling timing of the sustain pulse applied to the sustain electrode are consistent with the floating timing of the sustain electrode, the floating is maintained right before the rising or falling of the sustain pulse is started.

Figure 8A:
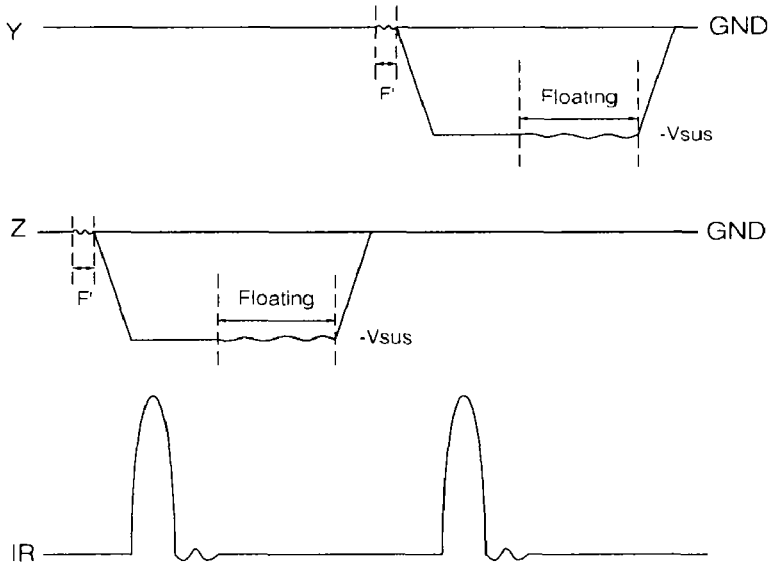
Figure 8B:
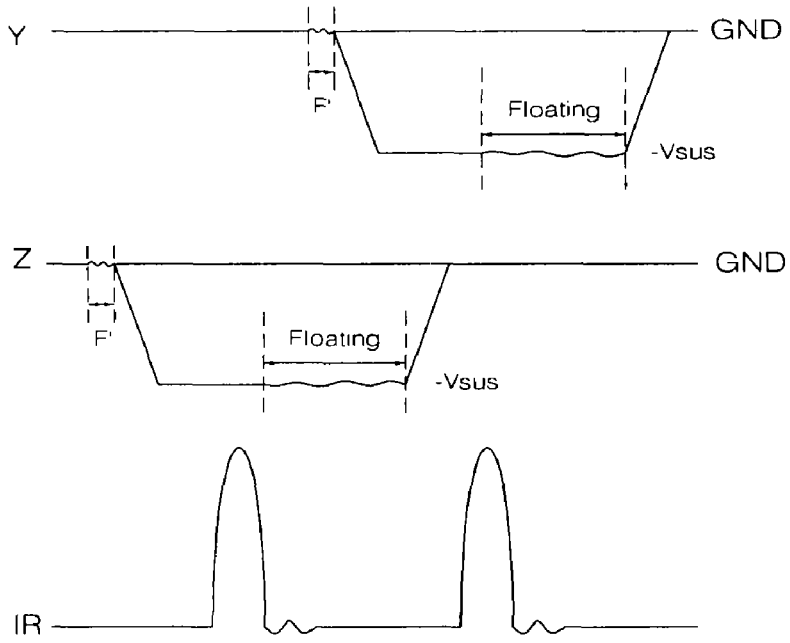
Figure 8C:
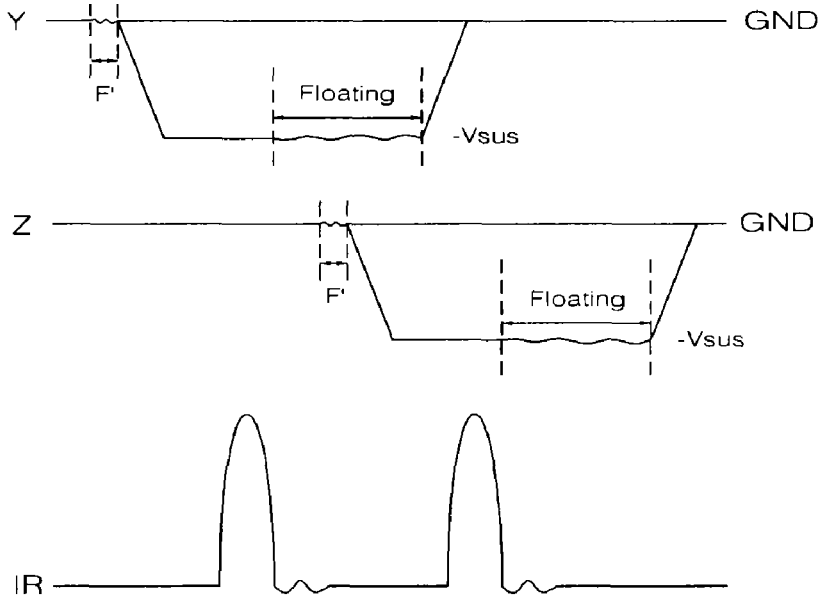
Figure 8D:
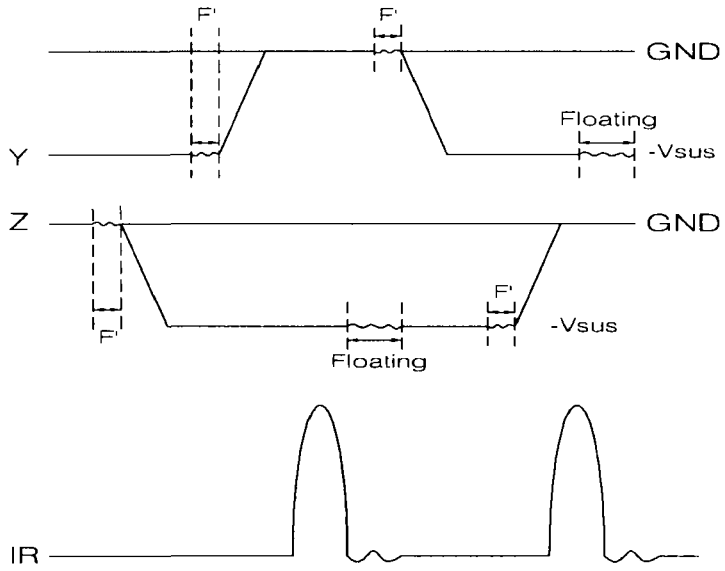

Waveforms of sustain pulses shown in FIGS. 11A through 11D are the same as waveforms of sustain pulses shown in FIGS. 8A through 8D in aspects of the form and the discharge timing but are different in that the floating is caused when the electrode is applied with the ground level in FIGS. 11A through 11D but the floating is caused when the electrode is applied with the negative sustain voltage −Vsus in FIGS. 8A through 8C.

Figure 12A:
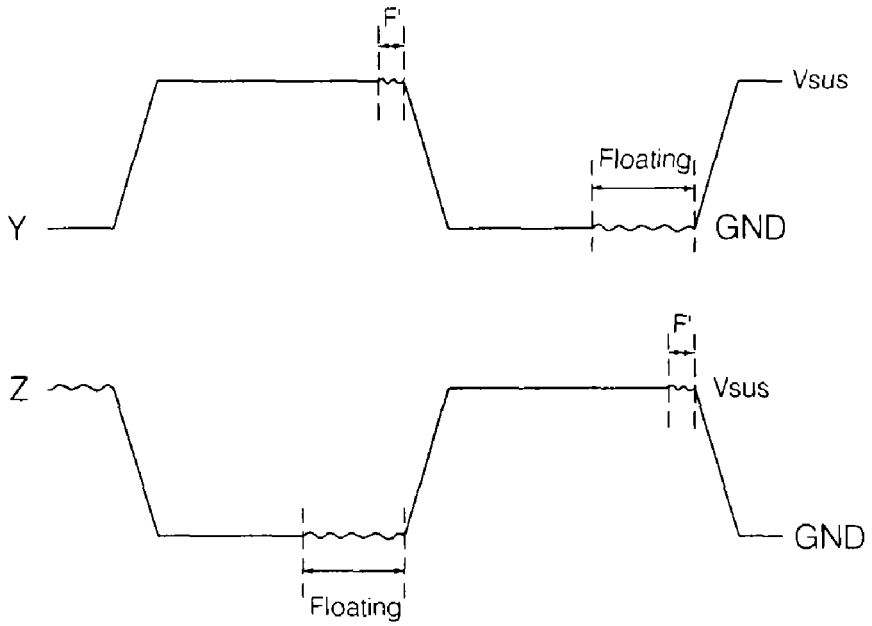
Figure 12B:
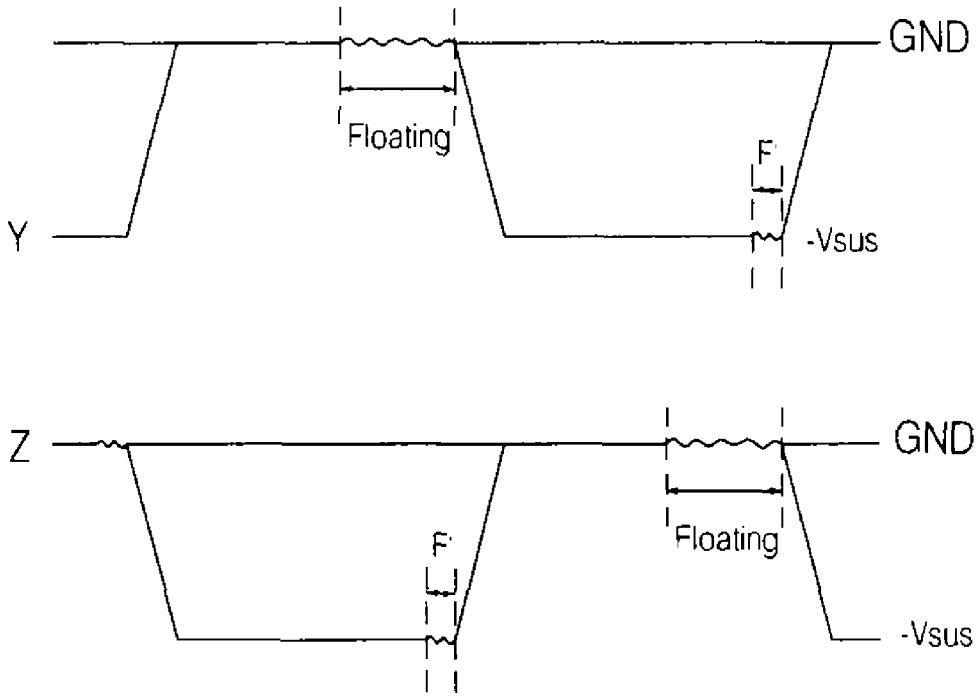

Waveforms of sustain pulses shown in FIGS. 12A through 12B are the same as waveforms of sustain pulses shown in FIGS. 9A through 9B in aspects of the form and the discharge timing but are different in that the floating is caused when the electrode is applied with the ground level in FIGS. 12A through 12B but the floating is caused when the electrode is applied with the positive sustain voltage Vsus in FIGS. 9A through 9B.

In the sustain pulses shown in FIGS. 5A through 5C, 6A through 6B, 7A through 7H, 8A through 8D, 9A through 9B, 10A through 10*d*, 11A through 11D and 12A through 12B for driving a plasma display panel, according to embodiments of the present invention, it is found that at least one of the scan electrode Y and the sustain electrode is floated after the sustain discharge occurs and is then completed.

The floating periods F in the sustain pulses shown in FIGS. 5A through 5C, 6A through 6B, 7A through 7H, 8A through 8D, 9A through 9B, 10A through 10*d*, 11A through 11D and 12A through 12B are ½ times a low voltage sustaining period or shorter, or ½ times a high voltage sustaining period or shorter. More particularly, the floating period F is preferably 100 or 1000 nanoseconds.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a first substrate;

a second substrate;

a first electrode and a second electrode formed on the first substrate; and a sustain driver for applying sustain pulses to at least one of the first and second electrodes, wherein the sustain driver applies a voltage whose magnitude is ½ times as large as a sustain voltage to one of the first and second electrodes, and then, right after completion of a sustain discharge caused by one of the sustain pulses and before the completion of the sustain pulse, during a sustain period, begins to float the one of the first and second electrodes for a duration of 100 ns to 1000 ns, and wherein a floating period during which the one of the first and second electrodes is floated is one half the duration or shorter of a period during which the highest level of the sustain pulses continuously occurs.

2. The plasma display apparatus as claimed in claim 1, wherein the sustain driver floats at least one of the first and second electrodes for 300 ns to 1000 ns.

3. The plasma display apparatus as claimed in claim 1, wherein the sustain driver applies the voltage whose magnitude is ½ times as large as a sustain voltage to the first electrode, and then floats the second electrode.

4. The plasma display apparatus as claimed in claim 1, wherein the sustain driver floats at least one of the first and second electrodes, and then applies a signal falling to a first predetermined voltage to at least one of the first and second electrodes.

5. The plasma display apparatus as claimed in claim 1, wherein the sustain driver floats at least one of the first and second electrodes, and then applies a signal rising to a second predetermined voltage to at least one of the first and second electrodes.

6. The plasma display apparatus as claimed in claim 1, wherein a floating period during which one of the first and second electrodes is floated is a half of a low level sustaining period of the sustain pulses or shorter.

7. The plasma display apparatus as claimed in claim 1, wherein one of the first and second electrodes is floated at a halfway point of a low level sustaining period of the sustain pulses or in a later half period of the low level sustaining period.

8. The plasma display apparatus as claimed in claim 1, wherein one of the first and second electrodes is floated at a halfway point of a low level sustaining period of the sustain pulses or in a later half period of the low level sustaining period.

9. The plasma display apparatus as claimed in claim 1, wherein the sustain driver alternately floats the first and second electrodes.

10. The plasma display apparatus as claimed in claim 1, wherein the sustain driver applies a negative voltage whose magnitude is ½ times the sustain voltage to one of the first and second electrodes, and then floats the electrode applied with the negative voltage.

11. A sustain driving method of a plasma display apparatus, the method applying sustain pulses to at least one of a first electrode and a second electrode formed on an upper substrate of a plasma display panel, comprising:

applying a voltage whose magnitude is ½ times as large as a sustain voltage to one of the first and second electrodes; and beginning to float, right after completion of a sustain discharge caused by one of the sustain pulses and before the completion of the sustain pulse, during a sustain period, the one of the first and second electrodes for a duration of 100 ns to 1000 ns, wherein the floating is performed for a duration of one half or shorter of a duration during which a high level sustaining period or a low level sustaining period of the sustain pulses continuously occurs.

12. The sustain driving method of a plasma display apparatus as claimed in claim 11, wherein the floating is performed for 300 ns to 1000 ns.

13. The sustain driving method of a plasma display apparatus as claimed in claim 11, wherein the floating is started at a halfway point of a high level sustaining period or a low level sustaining period of the sustain pulses, or later.

14. The plasma display apparatus of claim 1, wherein the sustain driver begins to float the at least one of the first and second electrodes concurrent with the completion of the sustain discharge caused by the voltage during the sustain period.

15. A plasma display apparatus comprising:

a first substrate;

a second substrate;

a first electrode and a second electrode formed on the first substrate; and a sustain driver for applying sustain pulses to at least one of the first or second electrodes, wherein the sustain driver applies a voltage to one of the first or second electrodes, and then, concurrent with completion of a sustain discharge caused by one of the sustain pulses and before the completion of the sustain pulse during a sustain period, immediately begins to float the same one of the first or second electrodes, and wherein a total duration of the period during which the one of the first or second electrodes is floated is one half the duration or shorter of the period during which the one of the sustain pulses is continuously applied.

* * * * *